US008528126B2

(12) United States Patent
Al-Mahnna

(10) Patent No.: US 8,528,126 B2
(45) Date of Patent: Sep. 10, 2013

(54) APPARATUS AND/OR DEVICE FOR PERSONAL HYGIENE

(76) Inventor: Khaled Abdullah M. Al-Mahnna, Salmiya (KW)

( * ) Notice: Subject to any disclaimer, the term of this patent is extended or adjusted under 35 U.S.C. 154(b) by 362 days.

(21) Appl. No.: 12/916,666

(22) Filed: Nov. 1, 2010

(65) Prior Publication Data

US 2012/0102638 A1 May 3, 2012

(51) Int. Cl.
*A47K 1/00* (2006.01)

(52) U.S. Cl.
USPC ..... 4/626

(58) Field of Classification Search
USPC ..... 4/625, 626
See application file for complete search history.

(56) References Cited

U.S. PATENT DOCUMENTS

| | | | | |
|---|---|---|---|---|
| 3,045,252 | A * | 7/1962 | Sorrells | 4/626 |
| 3,869,183 | A | 3/1975 | Frank, Jr. | |
| 4,130,123 | A * | 12/1978 | Wines et al. | 134/56 R |
| 5,465,438 | A * | 11/1995 | Allman et al. | 4/626 |
| 5,640,723 | A | 6/1997 | Stanek | |
| 5,702,115 | A * | 12/1997 | Pool | 280/47.35 |
| 6,173,458 | B1 * | 1/2001 | Maddux | 4/626 |

* cited by examiner

*Primary Examiner* — Huyen Le
(74) *Attorney, Agent, or Firm* — Lowe Hauptman Ham & Berner, LLP

(57) ABSTRACT

An apparatus and/or device for personal hygiene by a person who is confined to a room or bed includes a first clean water storage tank, a second used water storage tank and a basin between the two tanks and wherein the first tank is disposed above the basin and the used water tank is below the basin. The apparatus and device also includes four adjustable legs with casters thereon as well as a frame assembly including upper and lower frame portions. A pair of forwardly extending arms and privacy curtains provides a modicum of privacy. In addition a fluid soap dispenser, soap dish and mirror as well as an electric blow dryer, retractable electric cord and electrical sockets are also provided.

7 Claims, 2 Drawing Sheets

APPARATUS AND/OR DEVICE FOR PERSONAL HYGIENE

FIELD OF THE INVENTION

This invention relates to a portable apparatus and/or device for personal hygiene by an individual who is confined to a room or bed and more particularly to a portable apparatus and/or device that has a first storage tank for storing clean water, a second storage tank for storing used water and a wash basin between the two tanks.

BACKGROUND FOR THE INVENTION

Portable sinks are well known and have been in use for many years. For example, a U.S. Pat. No. 5,301,376 of Herbert discloses a portable sink that is arranged for ease of transportation and storage. The sink includes a central housing having respective lower and upper housings positioned on opposite sides of the central housing. As disclosed, the upper housing includes a fluid reservoir structure arranged for orthogonal orientation relative to the central housing with a faucet permitting fluid to flow upon pivoting of the faucet relative to a floor cavity within the upper housing floor. A lower housing includes an upper housing reservoir in communication with a sink within the central housing for storage and subsequent disposal of fluid within the lower housing.

A more recent U.S. Patent of Patterson, U.S. Pat. No. 6,959,460 discloses a portable wash basin device wherein the device includes a sink for receiving fresh water therein for permitting a user thereof to wash. The sink defines an open top for the reception therein of the fresh water so that the user is permitted to wash therein. A container is disposed adjacent to the sink for containing the fresh water and a pump is operatively connected to the container for pumping the fresh water from the container into the sink. A lid is secured to the sink such that when the lid is disposed in an open disposition thereof access to the sink by the user thereof is permitted and when the lid is disposed in a closed position thereof the lid covers the sink.

Finally, an improved portable sink for use by the handicap is disclosed in a U.S. Pat. No. 7,331,070 of Al-Anezi. As disclosed, the portable sink includes a base member and a plurality of foldable legs for supporting the base member above a surface when in a first position and foldable flat against the base member for storage and transport. The sink also includes a first storage tank for containing a supply of clean water, a concave basin and a second storage tank for receiving dirty water from the concave basin. The base member also includes a support member for supporting the first storage tank above the level of the concave basin and means for supporting the second storage tank below the level of the concave basin with the lower part of the concave basin in contact with a top portion of the second storage tank. In addition, a fluid passage is provided between the lower part of the concave basin and the upper part of the second storage tank with a normally closed one-way depressible valve connecting the lower part of the basin and the second storage tank. This valve prevents water from the second storage tank from flowing back into the concave basin. In addition, a separate depressor constructed and arranged for manually depressing the valve is also provided for opening the valve to drain the dirty water from the basin and into the second storage tank. Finally, a cover fits over the base member with means for releasably fastening the cover to the base member.

Notwithstanding the above, it is presently believed that there is a need and a potential commercial market for a further improvement in a portable apparatus and/or device for personal hygiene by an individual who is confined to a room or bed. It is believed that there is a commercial market for such devices because they are more complete than many of the prior art devices by providing electricity for an electric dryer and shaver as well as a soap holder, brush holder, force of clean water and a storage tank for used water. Such devices are particularly suitable for moving from one side of a room to a bed or from a portion from another room to an occupied room for use by the occupant. The devices in accordance with the present invention are also believed to be manufactured at a competitive price and are durable and provide sufficient water for use by an individual in their personal hygiene.

BRIEF SUMMARY OF THE INVENTION

In essence the present invention contemplates a portable apparatus and/or device for personal hygiene by an individual who is confined to a room or bed and more particularly to a portable apparatus and/or device that has a first storage tank for storing clean water, a second storage tank for storing used water and a wash basin between the two tanks. In a preferred embodiment of the invention the first storage tank for dispensing water into the basin is disposed above the basin while the second storage tank is provided below the tank for receiving spent water or used water from the basin. The apparatus and/or device also includes a frame member including four legs and four casters the bottom of the legs for moving the apparatus from one room to another or from one portion of the room over next to a bed. The frame member includes a lower frame supporting the second storage tank above a floor and for joining a first of one of said legs to a second of said legs and a third of said legs to a fourth of said legs as well as two cross members connecting said second of said legs to said fourth of said legs and each of said legs including means to raise and lower the height of the basin in order to accommodate beds of different heights. An outwardly extending faucet extends outwardly from the first storage tank over the basin for directing a stream of water over the hands of an individual and into the basin and the basin includes a closeable drain hole in a lower portion thereof and a hose connecting said drain whole and said second storage tank. A pair of forwardly extending arms in an upper portion of the frame extends over the basin and a pair of privacy curtains extends downwardly from the forwardly extending arms to opposite sides of the basin. Further, an extendable towel rack extends outwardly from an upper side member of the frame below the curtains. Further, the apparatus includes a housing having a face portion above the basin and facing an individual user and enclosing a first storage tank and a mirror is disposed on the face portion on one side thereof, a soap dish and tooth brush holder on opposite sides thereof and a fluid soap dispenser adjacent the faucet.

The invention will now be described in connection with the accompanying drawings wherein like reference numerals have been used to indicate like parts.

DESCRIPTION OF THE PREFERRED EMBODIMENTS OF THE INVENTION

Figure 1:
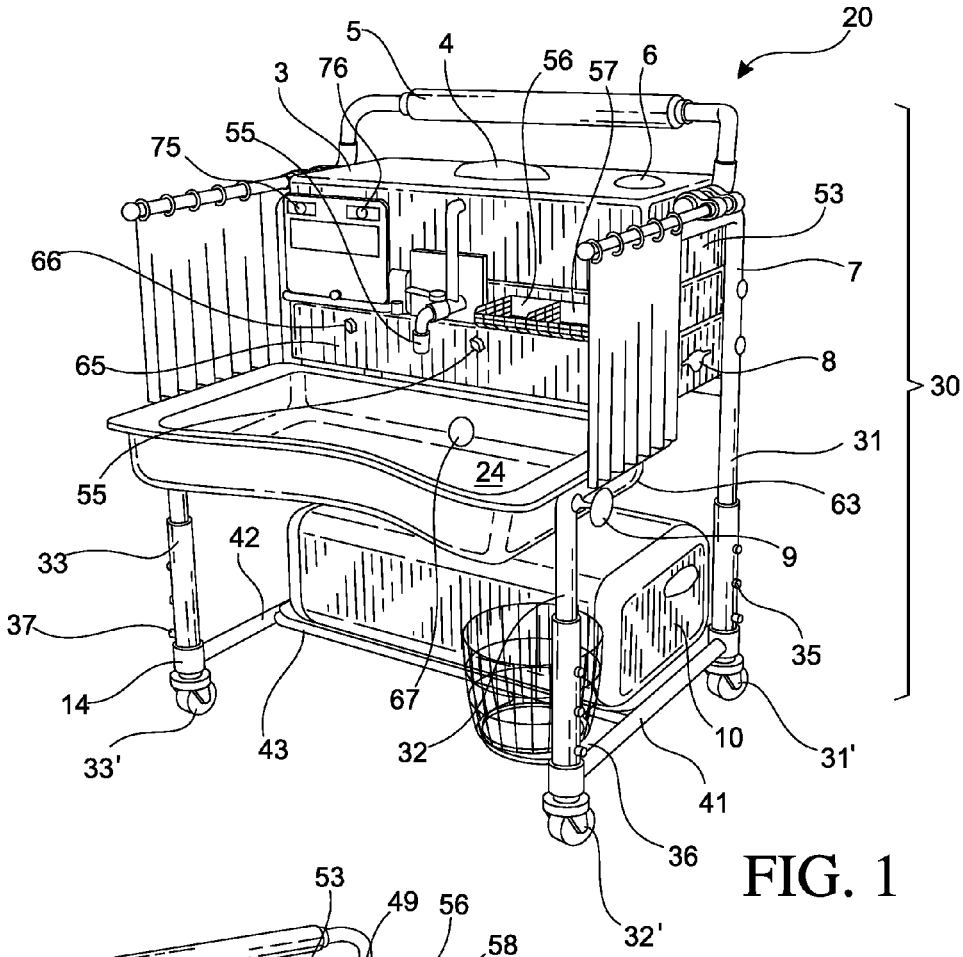
FIG. 1 is a perspective view illustrating a portable apparatus and/or device for personal hygiene by a person who is confined to a room or bed that shows the front and a first side of the apparatus or device.
Figure 2:
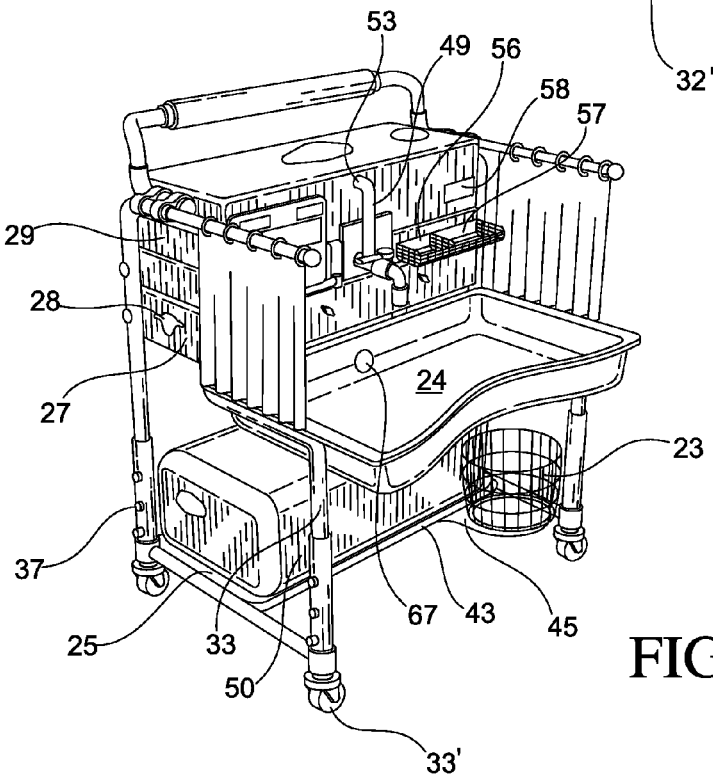
FIG. 2 is a perspective view illustrating a portable apparatus and/or device for personal hygiene by a person who is confined to a room or bed that shows the front and a second side of the apparatus or device.

A portable apparatus or device 20 for personal hygiene by an individual that is confined to a room or bed includes a frame assembly 30 that includes four generally vertical legs 31, 32, 33, and 34 with a caster 31', 32', 33' and 34' at the bottom of each leg for moving the apparatus or device 20 from one room to another or from one side of a room to another part of a room as for example next to a bed. The legs 31, 32, 33, and 34 each include adjustment means 35, 36, 37, and 38 respectively for raising and lowering a basin 24 to accommodate beds or chairs of different heights.

A lower portion of the frame assembly 30 includes a first tubular member 41 that extends between the legs 31 and 32 and rigidly connects two of the legs together. The frame assembly 30 also includes a second tubular member 42 that is rigidly connected to legs 33 and 34 and a pair of cross members 43 and 44 connecting the tubular members 41 and 42 to form a square portion of the lower frame that supports a second storage tank 50 for storing water that has been used for washing. The first tubular member 41 and the cross member 43 also provide a support 43' for supporting a rubbish basket 40. The legs 32 and 33 which are in the front of the apparatus or device 20 proceed upwardly from the floor to a level immediately below the top surface of the basin 24. At this point the legs are turned rewardly by about 90 degrees to the back of the basin 24 and are again turned about 90 degrees to extend upwardly along a front portion of a first clean water storage tank 48 or housing 53 to partially form an upper portion of the frame assembly 30. The tubular member that forms an upper portion of the frame assembly is again turned about 90 degrees toward the rear of the apparatus or device 20 and is then bent 90 degrees to become part of the leg 31 or leg 34 to become a part of leg 34. An upper cross member 47 then rigidly connects to legs 31, and 35 to form a fairly rigid frame assembly. Finally, a tubular cross handle 59 is fixed to an upwardly extending elbow 60 and 61 to connect an upper horizontal portion of the upper frame from the forward legs 32 and 33 that connect to a top portion of legs 31 and 34 to add further rigidity to the frame assembly 30.

The clean water storage tank 48 is supported or rests upon the cross member 47 and on a rear portion of the stainless steel basin 24 that is supported by the rearwardly extending horizontal portions 63 and 64. If necessary for added rigidity and stability an additional cross member can be added between the portions 63 and 64 and along the rear portion of the basin 24.

The apparatus or device 20 also includes an upper housing 53 with a face plate 53' that covers the first clean water tank 48 and includes a water level indicator 49 that extends upwardly on the face plate 53' above a forwardly extending faucet number 55.

A fluid soap dispenser 55' is also adjacent the faucet 55. The face plate 53' also includes a soap holder 56 and brush holder 57 on one side of the face plate 53' as well as a clock 58 such as a digital clock. Further, an electric blow dryer 65 is provided with an on/off switch 66 for drying an individual's hands, face or hair and protrudes slightly on one side of the apparatus or device 20 just above the basin 24. A mirror 59 is positioned above the dryer 65 and the face plate 53'.

Figure 3:
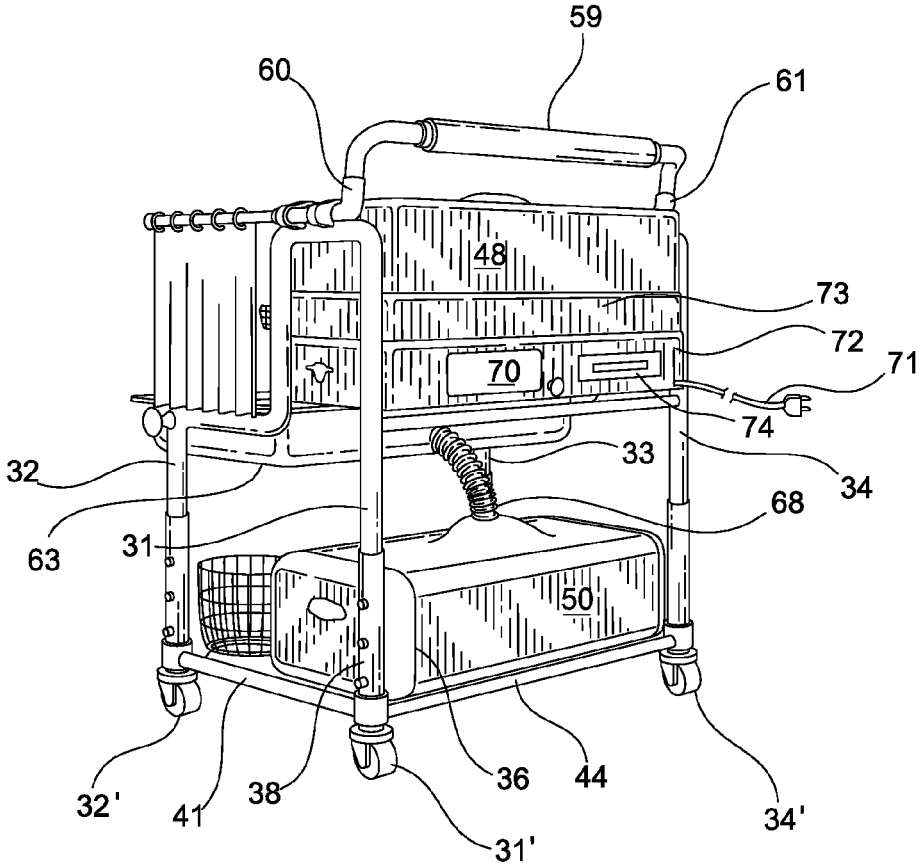
FIG. 3 is a perspective view illustrating a portable apparatus and/or device for personal hygiene by a person who is confined to a room or bed that shows the rear surface and the first side of the apparatus or device.

The basin 24 also includes a closeable drain hole 67 in a lower rear portion of the basin 24 and that is connected to the second storage tank 50 by a flexible hose 68 or other suitable connection. Further, as shown in FIG. 3 a storage drawer 70 is provided in a lower portion 72 of the housing 53 for a clean towel, wash cloth or the like. Also, a retractable electric cord 71 extends outwardly from a lower rear portion of the housing 53. In addition, a support 73 for the first clean water storage tank 48 is supported by the legs 31 and 34 and the lower portion 72 of the housing 53. Finally, a paper tissue or paper towel dispenser 74 (FIG. 3) is provided in one side of the lower portion 72 while electric sockets 75 and 76 for a shaver or the like are provided in an opposite side thereof.

While the invention has been described in connection with its preferred embodiment it should be recognized that changes and modifications may be made therein without departing from the scope of the appended claims.

What is claimed is:

1. A portable apparatus and/or device for personal hygiene by an individual who is confined to a room or bed comprising:

a first storage tank for storing a supply of clean water, a second storage tank for storing dirty water and a generally rectangular concave basin between said storage tanks with said first storage tank above said basin for dispensing water into said basin and said second storage tank below said basin for receiving dirty water from said basin;

a frame member including four legs and four casters on a bottom portion of said legs for moving said apparatus and/or device from one room to another or from one portion of a room to another, and a lower frame supporting said storage tank above a floor and for joining a first one of said legs to a second of said legs and a third of said legs to a fourth of said legs and two cross members connecting said second and said fourth of said legs and each of said legs including means to raise and lower the height of said basin;

an outwardly extending faucet extending outwardly from said front storage tank over said basin for directing a stream of water over the hands of an individual and into said basin and said basin including a closeable drain hole in a rear portion thereof and a bottom rear portion thereof and a hose connecting said drain hole in said second storage tank;

a pair of forwardly extending arms in an upper portion of said frame extending over said basin and a privacy curtain extending downwardly from each other said arms to opposite sides of said basin;

an extendable towel rack extending outwardly from an upper side of said frame below said curtain; and a housing having a face portion above said basin and facing an individual, a mirror disposed on said face portion on one side thereof, a soap dish and toothbrush holder on an opposite side thereof and a fluid soap dispenser adjacent said faucet.

2. A portable apparatus and/or device for personal hygiene by an individual who is confined to a room or bed according to claim 1 which includes an electric dryer and means for connecting said dryer to a source of electricity and wherein said electric dryer is stored in a lower front portion of said housing.

3. A portable apparatus and/or device for personal hygiene by an individual who is confined to a room or bed according to claim 2 which includes a rubbish basket and means in a lower portion of said frame for supporting said rubbish basket thereon.

4. A portable apparatus and/or device for personal hygiene by an individual who is confined to a room or bed according to claim 3 in which said housing includes a removable cover having a handle for removing said cover and a closeable opening for adding water to said first storage tank.

5. A portable apparatus and/or device for personal hygiene by an individual who is confined to a room or bed according to claim 4 which includes a tissue dispenser on one side of said housing.

6. A portable apparatus and/or device for personal hygiene by an individual who is confined to a room or bed according to claim 5 which includes a horizontal push bar above said housing for pushing and positioning said apparatus and/or device.

7. A portable apparatus and/or device for personal hygiene by an individual who is confined to a room or bed consisting of:

a first storage tank for storing a supply of clean water, a second storage tank for storing dirty water and a generally rectangular concave stainless steel basin between said storage tanks with said first storage tank for dispensing water into said basin and said second storage tank below said basin for receiving used water from said basin;

a frame assembly including four legs and four casters on a bottom of said legs and a lower frame supporting said second storage tank above a floor and for rigidly joining a first of said legs to a second of said legs and a third of said legs rigidly to a fourth of said legs and two cross members for rigidly connecting said second of said legs to fourth of said legs and each of said legs including means for raising and lowering the height of said basin and said lower frame including means for supporting said rubbish basket above said floor in front of said second storage tank;

an outwardly extending faucet extending outwardly from said first storage tank over said basin for directing a stream of water over an individual's hands and into said basin and said basin including a closeable drain hole in a lower rear portion thereof and a hose connecting said drain hole to said second storage tank;

a pair of forwardly extending arms in an upper portion of said frame assembly extending over said basin and a privacy curtain extending downwardly from each of said forwardly extending arms to opposite sides of said basin and a towel hanger extending outwardly from an upper side member of said frame;

a housing having a face portion above said basin and facing the individual user in front of said first storage tank, a mirror fixed to said housing on a face portion thereof, a soap dish and a brush holder and an electric dryer disposed in said housing and extending outwardly therefrom in the direction of the user and means for connecting said apparatus or device to a source of electricity for powering said dryer and heating water passing through said faucet and having means for indicating the water level in said first storage tank on a face portion of said housing; and a rubbish basket and means for supporting said rubbish basket on said lower frame in front of said second storage tank, a tissue dispenser on a side of said housing and an electrical outlet for an electric razor in front of said housing and a cross bar at a top of said frame for providing and for pushing and positioning said apparatus or device in a room; and a portable washer featuring light weight and easiness of storage.

* * * * *